US010967342B2

(12) United States Patent
Tourel et al.

(10) Patent No.: US 10,967,342 B2
(45) Date of Patent: Apr. 6, 2021

(54) SYSTEM FOR MAKING A COSMETIC PRODUCT BY MIXING COMPONENTS FROM SEVERAL SINGLE-USE PACKAGING UNITS

(71) Applicants: LABORATOIRES M&L, Manosque (FR); SEB SA, Ecully (FR)

(72) Inventors: Cecile Tourel, Aix en Provence (FR); Magali Millet, Les Mees (FR); Philippe De Brugiere, Marly le Roi (FR); Mathilde Blondel, Dienay (FR); Olivier Le Grand, Messigny et Vantoux (FR); Maxime Javit, Lyons (FR)

(73) Assignees: DUOLAB INTERNATIONAL SÀRL, Plan-les-Ouates (CH); SEB SA, Ecully (FR)

( * ) Notice: Subject to any disclaimer, the term of this patent is extended or adjusted under 35 U.S.C. 154(b) by 268 days.

(21) Appl. No.: 15/517,024

(22) PCT Filed: Oct. 5, 2015

(86) PCT No.: PCT/FR2015/052669
§ 371 (c)(1),
(2) Date: Apr. 5, 2017

(87) PCT Pub. No.: WO2016/055725
PCT Pub. Date: Apr. 14, 2016

(65) Prior Publication Data

US 2017/0304789 A1 Oct. 26, 2017

(30) Foreign Application Priority Data

Oct. 7, 2014 (FR) ..... 1459620

(51) Int. Cl.
*B01F 11/00* (2006.01)
*B01F 3/20* (2006.01)
(Continued)

(52) U.S. Cl.
CPC ..... *B01F 11/0065* (2013.01); *A45D 34/00* (2013.01); *A45D 40/0087* (2013.01);
(Continued)

(58) Field of Classification Search
CPC ..... B01F 11/0065
(Continued)

(56) References Cited

U.S. PATENT DOCUMENTS 3,287,385 A * 11/1966 Joux ..... C07F 7/2208 554/156
3,332,670 A * 7/1967 Swartz ..... B01F 11/0065 366/342
(Continued)

FOREIGN PATENT DOCUMENTS

EP 0 256 012 A1 2/1988
EP 0695575 A2 2/1996
(Continued)

OTHER PUBLICATIONS

International Search Report, dated Dec. 7, 2015, from corresponding PCT application.

*Primary Examiner* — David L Sorkin
(74) *Attorney, Agent, or Firm* — Nixon & Vanderhye

(57) ABSTRACT

Disclosed is a system for production of a cosmetic product including: at least one first single-use packaging unit including a preset quantity of a first phase of a cosmetic product, at least one second single-use packaging unit including a preset quantity of a second phase of a cosmetic product, a machine including a mixer inside of which the mixture of the preset quantity of the first phase and the preset quantity of
(Continued)

the second phase is done automatically in order to end up with a cosmetic product directly consumable by the end consumer. The mixing is done in a manner such that neither the first phase nor the second phase are in direct contact with any part of the mixer which is not single use, thus avoiding dirtying the mixer.

27 Claims, 5 Drawing Sheets

(51) Int. Cl.

| | |
|---|---|
| ***B01F 15/02*** | (2006.01) |
| ***A45D 34/00*** | (2006.01) |
| ***A45D 40/00*** | (2006.01) |
| ***B01F 3/08*** | (2006.01) |

(52) U.S. Cl.
CPC ..... *B01F 3/0807* (2013.01); *B01F 3/2078* (2013.01); *B01F 15/029* (2013.01); *B01F 15/0215* (2013.01); *A45D 2200/058* (2013.01); *B01F 2003/0842* (2013.01)

(58) Field of Classification Search
USPC ..... 366/275
See application file for complete search history.

(56) References Cited

U.S. PATENT DOCUMENTS

| | | | | |
|---|---|---|---|---|
| 3,722,833 | A * | 3/1973 | Inoue | B65B 29/10 366/348 |
| 4,049,242 | A * | 9/1977 | Porter | B01F 11/0065 366/204 |
| 4,795,265 | A * | 1/1989 | Dahlberg | B01F 11/0065 206/219 |
| 5,865,309 | A | 2/1999 | Futagawa et al. | |
| 2008/0123466 | A1 * | 5/2008 | Thompson | B01F 11/0042 366/275 |
| 2010/0237163 | A1 | 9/2010 | Chomas et al. | |
| 2013/0221028 | A1 | 8/2013 | Robinson | |
| 2016/0286938 | A1 | 10/2016 | Ebeling | |

FOREIGN PATENT DOCUMENTS

| | | | |
|---|---|---|---|
| EP | 0 792 820 | A2 | 9/1997 |
| EP | 2 038 189 | A2 | 3/2009 |
| EP | 2 974 711 | A1 | 1/2016 |
| JP | S62-502316 | A | 9/1987 |
| JP | 2003-525817 | A | 9/2003 |
| JP | 2008-154955 | A | 7/2008 |
| JP | 3153059 | U | 8/2009 |
| JP | 2012-120766 | A | 6/2012 |
| KR | 101317425 | B1 | 10/2013 |
| WO | 86/05713 | A1 | 10/1986 |
| WO | 2008/006553 | A2 | 1/2008 |
| WO | 2013/096318 | A2 | 6/2013 |

* cited by examiner

SYSTEM FOR MAKING A COSMETIC PRODUCT BY MIXING COMPONENTS FROM SEVERAL SINGLE-USE PACKAGING UNITS

FIELD OF THE INVENTION

The invention relates to a system for production of a personalized cosmetic product from pre-dosed packaging units, also called pods, where the mixing of the content from the pre-dosed packaging units is done automatically by a machine and where the end consumer of the personalized cosmetic product only has to put the pre-dosed packaging units into the machine and retrieve the ready to use personalized cosmetic product.

BACKGROUND OF THE INVENTION

According to a first prior art, presented for example in the European patent EP 2,038,189, a system is known for production of a personalized cosmetic product from pods containing different base products, where these pods are opened and their content mixed with water within a machine.

The first disadvantage of this prior art concerns the management of the circulation of water and the mixing of the water with the content of the pods, which makes the structure the machine relatively complex.

A second drawback of this prior art concerns the cleaning which will both necessarily be tedious, because it affects all the internal parts of the machine having been in contact with the mixture, and will also need to be done relatively often, at least each time that the new personalized product will be incompatible or could be polluted by the components of the former personalized product previously made in the machine.

BRIEF DESCRIPTION OF THE INVENTION

The purpose of the present invention is to provide a system for production of a personalized cosmetic product from single-use pre-dosed packaging units at least partially relieving the aforementioned disadvantages.

The separation of the personalized cosmetic product components or phases prior to their mixture of course allows significant flexibility and a greater richness in the mixing possibilities that can be done, meaning a larger possible choice for the end consumer.

The separation of personalized cosmetic product components or phases prior to their mixing, also allows both improved and longer storage before mixing and also allows limiting or even eliminating preservatives which could be required for conventional pre-mixed product during the sale thereof to the end consumer. The health of the end consumer is better preserved that way.

More particularly, the invention aims to provide a system for production of a personalized cosmetic product from single-use pre-dosed packaging units which is simultaneously both simple and effective to use and also whose cleaning is made much easier compared to the prior art, meaning that this cleaning is either nonexistent or at least very quick and simple to do.

For this purpose, the present invention proposes a cosmetic product production system including: at least one first single-use packaging unit including a preset quantity of a first phase of a cosmetic product, at least one second single-use packaging unit including a preset quantity of a second phase of a cosmetic product, a mixer inside of which the mixture of said preset quantity of the first phase and said preset quantity of the second phase is done automatically in order to end up with a cosmetic product directly consumable by the end consumer, characterized in that said mixing is done in a manner such that neither the first phase nor the second phase are in direct contact with any part of said mixer which is not single use, thus avoiding dirtying said mixer.

The parts of the mixer are parts of the chamber where the mixing is done and which could therefore, in a conventional machine, come in contact with the content of the packaging units, thus leading to a risk of dirtying the inside of the mixer. The parts of the mixer which are therefore not single use are preferably parts which are difficult for the end consumer to access and parts which are not removable by the end consumer who can therefore not easily take them out of the mixer for cleaning outside of the mixer.

While the mixing of contents coming from two distinct packaging units which were previously separated from each other serves to greatly improve the mixing selection possibilities for the end consumer, without at the same time greatly multiplying the number of catalog items to offer for sale, the machine can also mix the contents of three packaging units, or even possibly mix the contents of a still larger number of packaging units.

When, in some documents from the prior art, the contents of two single-use packaging units are mixed together, it involves mixing an already stabilized emulsion with an addition of active elements. Hence, according to the invention, it was discovered that that it was also possible to mix a fatty phase and an aqueous phase, coming respectively from two single-use packaging units in order to create an emulsion. In fact, it was found that the mixing operation can be done simply and effectively in a machine, even when starting from fatty and aqueous phases completely separated in their respective packaging units.

For this purpose, the present invention also proposes a cosmetic product production system including: at least one first single-use packaging unit including a preset quantity of a fatty phase of a cosmetic product, at least one second single-use packaging unit including a preset quantity of an aqueous phase of a cosmetic product, a machine inside of which the mixing of said preset quantity of said aqueous phase and said preset quantity of said fatty phase is done automatically in order to end up with a cosmetic product directly consumable by the end consumer.

The production system according to the invention also relates both to a production device combining packaging units with the machine mixing the respective contents of these packaging units and also to a production process automatically mixing, inside of one machine, the respective contents of the respective packaging units that the end consumer put into this machine.

The purpose of the invention is also a process for production of a cosmetic product from at least one first single-use packaging unit including a preset quantity of a first phase of a cosmetic product, at least one second single-use packaging unit including a preset quantity of a second phase of a cosmetic product, inside a mixer, the mixing of said preset quantity of the first phase and said preset quantity of the second phase is done automatically in order to end up with a cosmetic product directly consumable by the end consumer, characterized in that said mixing is done in a manner such that neither the first phase nor the second phase are in direct contact with any part of said mixer which is not single use, thus avoiding dirtying said mixer.

According to preferred embodiments, the invention includes one or more of the following features which can be used separately or in partial combination among them or in complete combination of them where these features can be combined with any one of the previously described purposes: system, device or process.

Preferably, said mixture does not come out of the environment formed by both said packaging units and also by the junction formed between said packaging units at all or at least not before the homogenization of said mixture is finished. Thus, the mixing is going to be done inside of the environment made up by the two packaging units connected to each other, without leaving this environment, and therefore without risk of coming into contact with the inside of the machine, thus avoiding dirtying the machine. This is a simple and effective way for the content of the packaging units to not come in contact with the inside of the machine without also requiring other additional elements for mixing, where the packaging units alone are sufficient for mixing and where one additional element could be used in order to receive the mixture once it is done.

Preferably, said mixing includes at least the transfer of the content of one of said single-use packaging units to the other of said single-use packaging units. Thus, the mixing is going to be done inside of the environment made up by the two packaging units connected to each other, without leaving this environment, and therefore without risk of coming into contact with the inside of the machine, thus avoiding dirtying the machine. A simple transfer from one packaging unit to the other is going to allow starting the mixing without leaving these packaging units.

The homogenization for an emulsion consists of making an emulsion having a finer and finer dispersion of one phase in the other.

Preferably, the machine comprises a motorized device providing automatically the transfer of the content from one of the packaging units to one of the other packaging units. Advantageously, the motorized device automatically provides the transfer of the content from one of the packaging units to the other of the packaging units, inside the mixer of the machine.

Preferably, said transfer is repeated and reciprocal. Thus, the mixing can be done more efficiently such that the result of the mixing is more homogeneous since this homogeneity of the mixture is particularly important for an emulsion, which is defined as a fine dispersion of two or more initially, mutually immiscible phases, meaning for a cosmetic product consisting of one such emulsion. These roundtrips between the packaging units can be done as many times as necessary in order to homogenize the mixture; they therefore constitute an effective and at the same time simple way for making a fully homogeneous mixture without removing the mixture from the environment made up of the two packaging units connected to each other, thus avoiding the risk of dirtying the machine.

Preferably, said packaging units are filled at least partially or partially by said preset quantity of their cosmetic product phase before being put into said machine and are sufficiently flexible in order to increase volume so as to be able to contain said mixture in its entirety or almost in its entirety. It is preferable to limit or even eliminate the quantity of air initially included in the packaging units. Reducing or eliminating this quantity of included air makes easier the homogenization that could otherwise be disturbed by an initial quantity of included air that was too large.

Preferably, said packaging units were filled under vacuum before they are placed in said machine. In this way the quantity of air initially included in the packaging units can be limited or even eliminated. Reducing or eliminating this quantity of included air makes the homogenization easier that could otherwise be disturbed by an initial quantity of included air that was too large.

Preferably, said transfer is done through a narrowing located between said single-use packaging units. This narrowing improves homogenization of the mixture by forcing the contents of the packaging units to mix with each other because of the reduction of volume leading to an acceleration of the movement of the mixture through this narrowing, where this acceleration further increases the homogenization of the mixture. Preferably, said transfer is done by passing through a channel directly connecting the packaging units with each other, where this channel includes a narrowing through which the mixture passes in order to transit between said single-use packaging units.

Preferably, said transfer shears said content traversing said narrowing. To do that, the reduction in size around said narrowing must be sufficiently large in order to be able to effectively obtain this shearing effect which further increases the homogenization of the mixture.

Preferably, said narrowing has a size or a diameter which amounts to at most 20% of the size or diameter of the one or more packaging units which bear said narrowing, preferably at most 15% and still more preferably at most 12%. The size of the narrowing should advantageously not be reduced too much either, otherwise the passage of the mixture from one packaging unit to the other could take too long, thus indirectly reducing the homogenization speed of the mixture. Advantageously, said narrowing has a size or a diameter which amounts to at least 2% of the size or diameter of the one or more packaging units which bear said narrowing, and more advantageously at least 4% and still more advantageously at least 8%.

Preferably, in an embodiment, said cosmetic product, directly consumable by the end consumer, is stored in one of said single-use packaging units and/or in the other of said single-use packaging units. Thus, the simplicity of the production system in this way becomes further increased, because, apart from the packaging units including the phases or components from which the mixture was made, no additional element is needed even for the final phase of receiving the mixture constituting the ready to use personalized cosmetic product, meaning ready for use by the end consumer. Additionally, the use thereof becomes more practical, because the personalized cosmetic product can be applied by simple pressure on the packaging unit storing it.

Optionally, in another embodiment, said cosmetic product directly consumable by the end consumer is stored directly in a receptacle that is removable and external to the mixer of the machine, or even external to the machine itself. This other embodiment needs an additional element for receiving and very temporary storage of the personalized cosmetic product for immediate or nearly immediate use. This way the end consumer can be offered a practical receptacle; in fact, the receptacle can be relatively flat and a little flared which makes delivery of the personalized cosmetic product more direct. Additionally, this receptacle, which is advantageously metallic, for example stainless steel, has the advantage of cooling the personalized cosmetic product more quickly. This removable receptacle is to be cleaned after each use.

Preferably, said transfer is accompanied by a stirring of said preset quantity of the first phase and said preset quantity of the second phase in order to homogenize said mixture. This stirring of the various phases respectively coming from the various packaging units again serves to improve the homogenization of the resulting mixture.

Preferably, said stirring is done by application of mechanical pressure so as to move said mixture from one packaging unit to the other and vice versa. Thus, the transfer the mixture from one packaging unit to the other is done both simply and effectively.

Preferably said mixing is done by the use of pistons or by the use of rollers arranged so as to flatten one of the packaging units in order to move the content thereof into the other packaging unit. The proportion of the mixture effectively transferred with each passage is then greater, and the quantity of mixture remaining in one packaging unit after transfer thereof to the other packaging unit is then reduced.

Preferably, said stirring is accompanied by a heating of said preset quantity of the first phase and/or said preset quantity of the second phase in order to improve the homogenization of said mixture, where said heating can preferably be prior to said stirring. Stirring together of several phases which are simultaneously heated or which were just heated is more effective and further improves the homogenization of the mixture.

Preferably, said cosmetic product directly consumable by the end consumer is a homogenized emulsion or homogenized solution or mixture of several miscible phases like for example powder and an aqueous phase or a set of active lipophiles and an oily phase. Performing an advanced homogenization is even more important for an emulsion than for a solution.

Preferably said first single-use packaging unit includes a preset quantity of an excipient phase of a cosmetic product, and said second single-use packaging unit includes a preset quantity of a phase including active elements for a cosmetic product where said second packaging unit is advantageously sterilized. The mixing just before use by the end consumer of an excipient phase and a phase containing the active elements and the production of an instant-use single-dose avoids the addition of preservatives, unnecessary for cosmetic effects, and typically used in conventional cosmetics in order to allow a storage over time of the conventional cosmetic product.

Preferably said first single-use packaging unit includes a preset quantity of a fatty phase of a cosmetic product, and said second single-use packaging unit includes a preset quantity of an aqueous phase of a cosmetic product where said second packaging unit is advantageously sterilized. The mixing just before use by the end consumer of a fatty phase and an aqueous phase and the production of a single-dose for immediate use avoids the addition of preservatives, unnecessary for cosmetic effects, and typically used in conventional cosmetics in order to allow storage over time of the conventional cosmetic product.

The fatty phase or the excipient phase orients the type of the care base, whereas the aqueous phase or the phase containing active elements mostly constitutes the complex of actives.

Preferably, said fatty phase of said cosmetic product can be of different types corresponding to different forms, and said aqueous phase of said cosmetic product can include different groups of active elements corresponding to different skin needs of an end consumer. The different forms are for example a milk or a cream. Thus, the end consumer, who can be either a male or female consumer, can choose the type of care base suited to them independent of the type of actives complex which is suited to their skin.

Other features and advantages of the invention will appear upon reading the following description of a preferred embodiment of the invention, given as an example and with reference to the attached drawings.

DETAILED DESCRIPTION OF THE INVENTION

Figure 1:
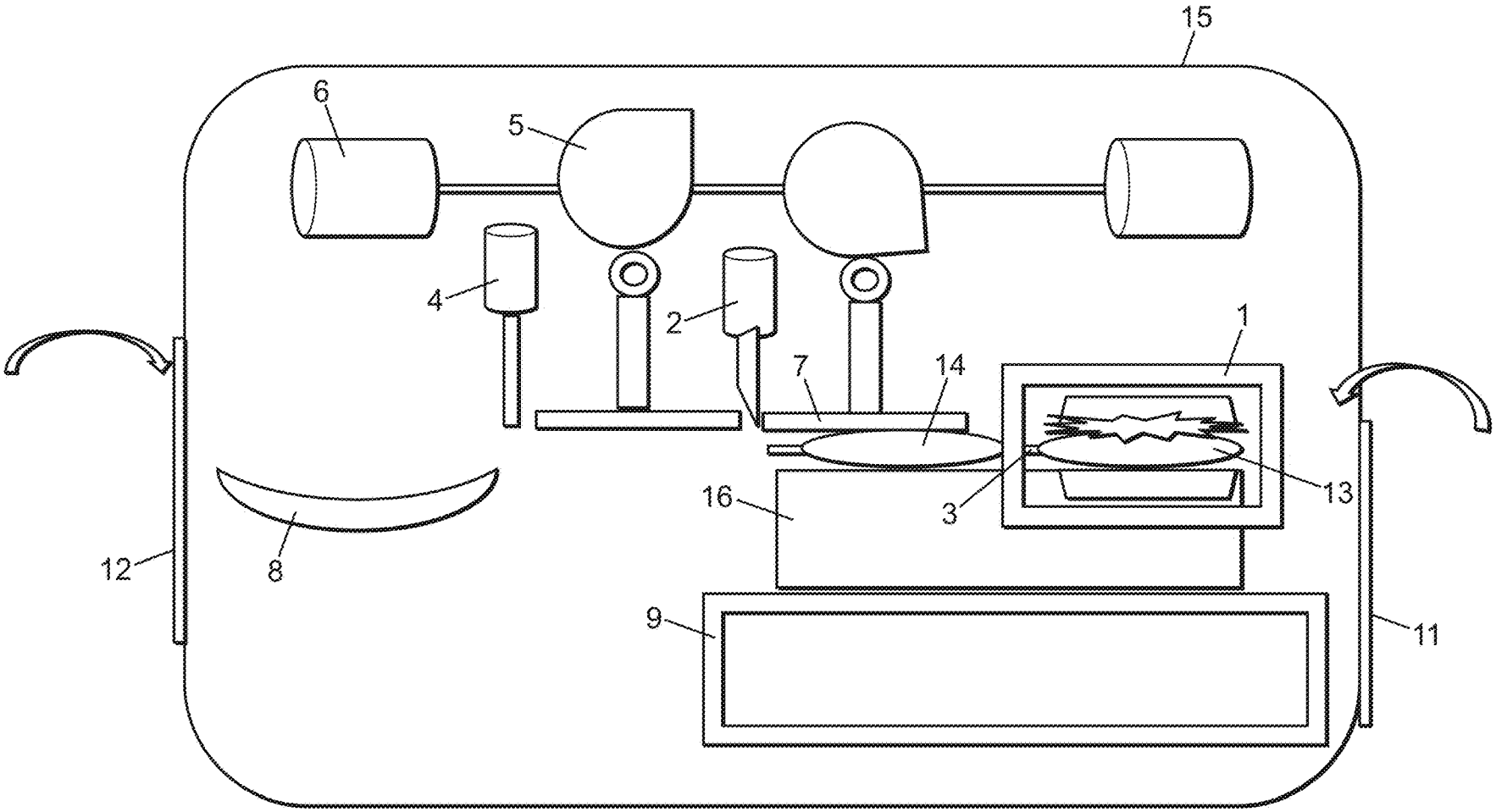
FIG. 1 shows schematically an example of a production system according to an embodiment of the invention shown in a state corresponding to a first phase of a production process according to an embodiment of the invention.

The production system described in connection with FIGS. 1 to 5 includes a machine 15 using two packaging units 13 and 14.

These two packaging units 13 and 14 are also called capsules 13 and 14 when they are two capsules independent from each other or also called capsule compartments when they are originally connected to each other. The packaging unit 13 includes a fatty phase which is an excipient phase while the packaging unit 14 includes an aqueous phase which is a complex of actives phase. A link 3, whose state can vary during the production process, connects the packaging units 13 and 14 to each other. The link 3 is preferably a somewhat cylindrical channel.

The machine 15 includes a heating device 1, a tool for connecting two packaging units 13 and 14 to each other, a tool for holding 4 in closed position the area for possible emptying of packaging unit 14, a set of two cams 5 driven rotationally, a motor 6 providing a cyclical movement to the cams 5, a set of pistons 7 whose vertical translational movement is driven by the rotation of the cams 5, a cup 8 for receiving the personalized cosmetic product 10, a reservoir for emptying 9 packaging units 13 and/or 14, an access hatch 11 for putting the conditioning units 13 and 14 into the machine 15, a withdrawal door 12 for taking the removable cup 8 outside of the machine 15 and a tray 16 onto which the packaging units 13 and 14 are arranged while the mixture is made and homogenized. The mixer, making and homogenizing the mixture, includes the parts 2, 7, 16.

FIG. 1 shows schematically an example of a production system according to an embodiment of the invention shown in a state corresponding to a first phase of a production process according to an embodiment of the invention.

In an embodiment, the compartments 13 and 14 of a capsule are put inside the machine 15 by the end consumer after having opened a hatch 11. Then the end consumer re-closes the hatch 11. Before or after that, the end consumer replaces the cup 8 inside the machine 15 after having cleaned it after a previous use and after having opened the door 12. Next, the end consumer closes the door 12. The machine 15 is ready for use. The compartment 14 had been inserted before the compartment 13. The compartments 13 and 14 are placed on the tray 16. The movements for closing the hatch 11 and the door 12 are indicated on FIG. 1 by curved arrows.

The compartment 13 is located in the area of the heating device 1. The end consumer just needs to press on a "start" button, not shown, in order for the production process to be initiated. The fatty phase contained in compartment 13 is then warmed by the heating device 1. The step of heating of compartment 13 is indicated by a multi-branch star located right above the compartment 13.

Alternatively, the heating device 1 is not present and the fatty phase is not warmed. It is also possible to provide a larger heating device which can warm both compartments 13 and 14 simultaneously.

Alternatively, two capsules 13 and 14, separate from each other, are put into the machine 15, the capsule 14 before the capsule 13 with the capsule 13 pushing the capsule 14 towards the inside of the machine 15. The capsules 13 and 14 can also have been connected to each other by the end user who can slide a narrow tip from one of the capsules into a broad tip from the other capsule before sliding the assembly into the machine 15.

Figure 2:
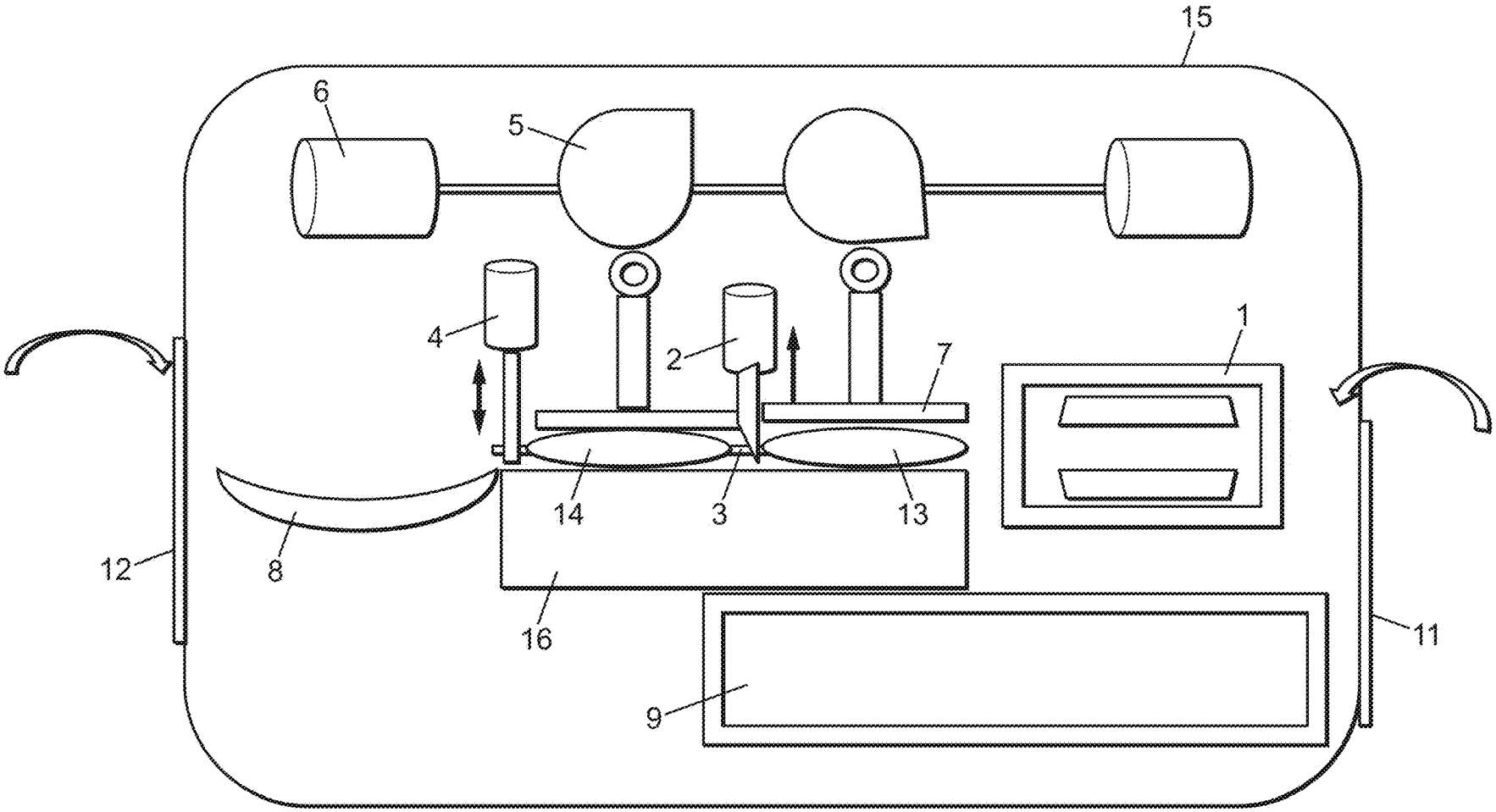
FIG. 2 shows schematically an example of a production system according to an embodiment of the invention shown in a state corresponding to a second phase of a production process according to an embodiment of the invention.

FIG. 2 shows schematically an example of a production system according to an embodiment of the invention shown in a state corresponding to a second phase of a production process according to an embodiment of the invention.

In an embodiment, the tray 16 moves so as to bring the compartment 13 outside of the heating device and so as to bring the compartments 13 and 14 respectively under the pistons 7. The pistons 7 do not exert a large pressure on the compartments 13 and 14 in order to empty their content; they can exert a light pressure for keeping the compartments 13 and 14 in place on the tray 16. The tool for connecting 2 connects the compartments 13 and 14 with each other, for example by coming to exert a pressure on the link 3 so as to eliminate the separation between compartments 13 and 14, where the separation was arranged inside this link 3. This separation can be a partition or membrane blocking the link 3 the tool for connecting 2 comes to move or detach so as to make this link 3 connecting between compartments 13 and 14. The tool for holding 4 exerts a mechanical pressure on the emptying area of the compartment 14 in order to avoid a leak of the mixture into the mixer, in the case where the personalized cosmetic product is going to be recovered in the cup 8. The narrowing, corresponding to the inner diameter of the link 3, has a size or diameter which amounts to at most 20% of the height of the compartments 13 and 14 because they both have this narrowing, preferably at most 15%, and still more preferably at most 12%.

Alternatively, the tool for connecting 2 can be a mechanical slicer of link 3, with a device not shown coming to reestablish the sealed link between the compartments 13 and 14 by nesting a portion of the link 3 located on one side of the cut into another part of the link 3 located on the other side of the cut. These two parts of the link 3 will in this case advantageously have different diameters. The cup 8 can also be eliminated, and in this case, the personalized cosmetic product is retrieved in the compartment 14 itself which no longer comprises an emptying area; the personalized cosmetic product is emptied from the compartment 14 through the open tip of the link 3 by manual pressure exerted by the end consumer.

Alternatively, two capsules separated or connected to each other by the end consumer having been inserted, the tool for connecting 2 will maintain the seal of this link 3 by mechanical pressure on the two parts of the link 3, advantageously distributed all around this link 3. In order to do that, in the case where the capsules are inserted by the end consumer separated from each other a device not shown comes to reestablish the sealed link between the compartments 13 and 14 by nesting a part of the link 3 attached to one of the capsules inside a part of the link 3 attached to the other capsule. The cup 8 can also be eliminated, and in this case, the personalized cosmetic product is retrieved in the compartment 14 itself which no longer comprises an emptying area; the personalized cosmetic product is emptied from the compartment 14 through the open tip of the link 3 by manual pressure exerted by the end consumer.

Figure 3:
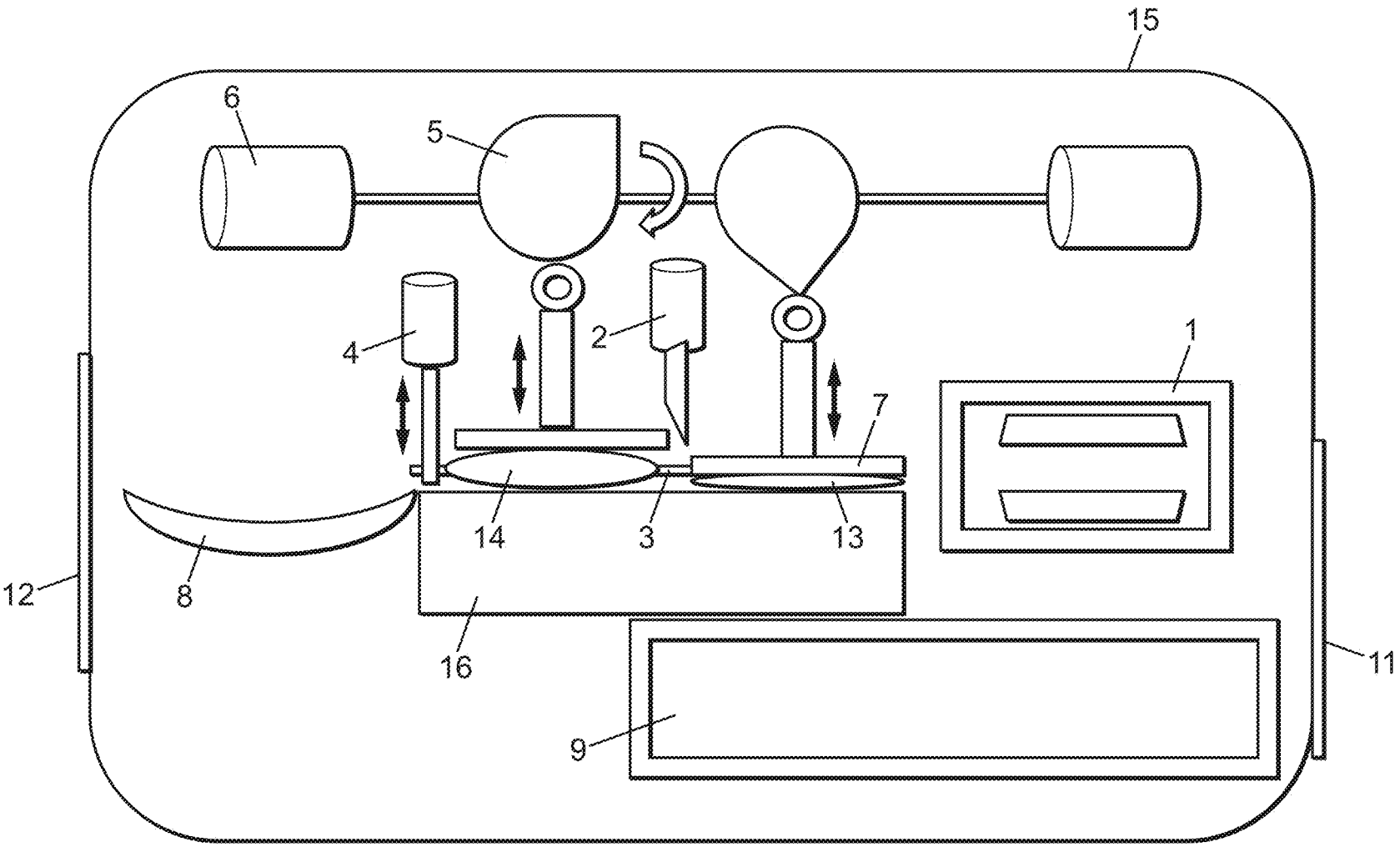
FIG. 3 shows schematically an example of a production system according to an embodiment of the invention shown in a state corresponding to a third phase of a production process according to an embodiment of the invention.

FIG. 3 shows schematically an example of a production system according to an embodiment of the invention shown in a state corresponding to a third phase of a production process according to an embodiment of the invention.

In an embodiment, the cams 5 turn thereby driving the vertical translation movements of pistons 7. The cams 5 are structured and arranged such that the vertical movement of the pistons 7 is alternating, meaning that on the one hand when the first piston 7 is in a lower position and flattening the compartment 13, as in FIG. 3, the second piston 7 is an upper position and does not flatten the compartment 14 and that reciprocally on the other hand when the piston 7 is in a lower position and flattens the compartment 14, the first piston 7 is an upper position and does not flatten compartment 13. The opposite and alternating vertical movement of pistons 7 serves to alternately empty the mixture from compartment 13 into compartment 14 and from compartment 14 into compartment 13. This cycle of transfer of the mixture from one compartment to the other with return of the mixture is done a number of times that is sufficient for the mixture to be well homogenized. The smaller the section of the channel constituting the link 3 is then the smaller the required number of cycles to be done in order to obtain a satisfactory homogenization of the mixture. The tool for connecting 2 advantageously keeps the link 3 sealed from the outside, while allowing communication between the compartments 13 and 14 by crimping the central part of the connecting channel between compartments 13 and 14 until the mixture passing from one compartment to the other is homogenized. All the time that the mixture is being homogenized, the tool for holding 4 keeps a mechanical pressure on the emptying area of the compartment 14 in order to avoid leaks in the mixer. Each time that the mixture is transferred from one compartment to the other, it is all of the mixture which is transferred at once. On each passage through the narrowing which constitutes the sealed link 3, the mixture is sheared, therefore even better mixed, and finally more and more homogenized.

Alternatively, the machine operates similarly with capsules 13 and 14 connected to each other and the tool for connecting 2 can advantageously maintain the seal of the link.

The mixture is homogenized by the transfer from one compartment to the other or from one capsule to the other since the transfer forces the phases to mix with each other and this is increased because this transfer is reciprocal and repeated. The mixture is also homogenized by the shearing done during passage of this mixture through the narrowing which further mixes the phases with each other. The mixture is also homogenized by the heating of at least one of the phases which fluidifies all of the mixture helping the mixing of the phases with each other even more.

Figure 4:
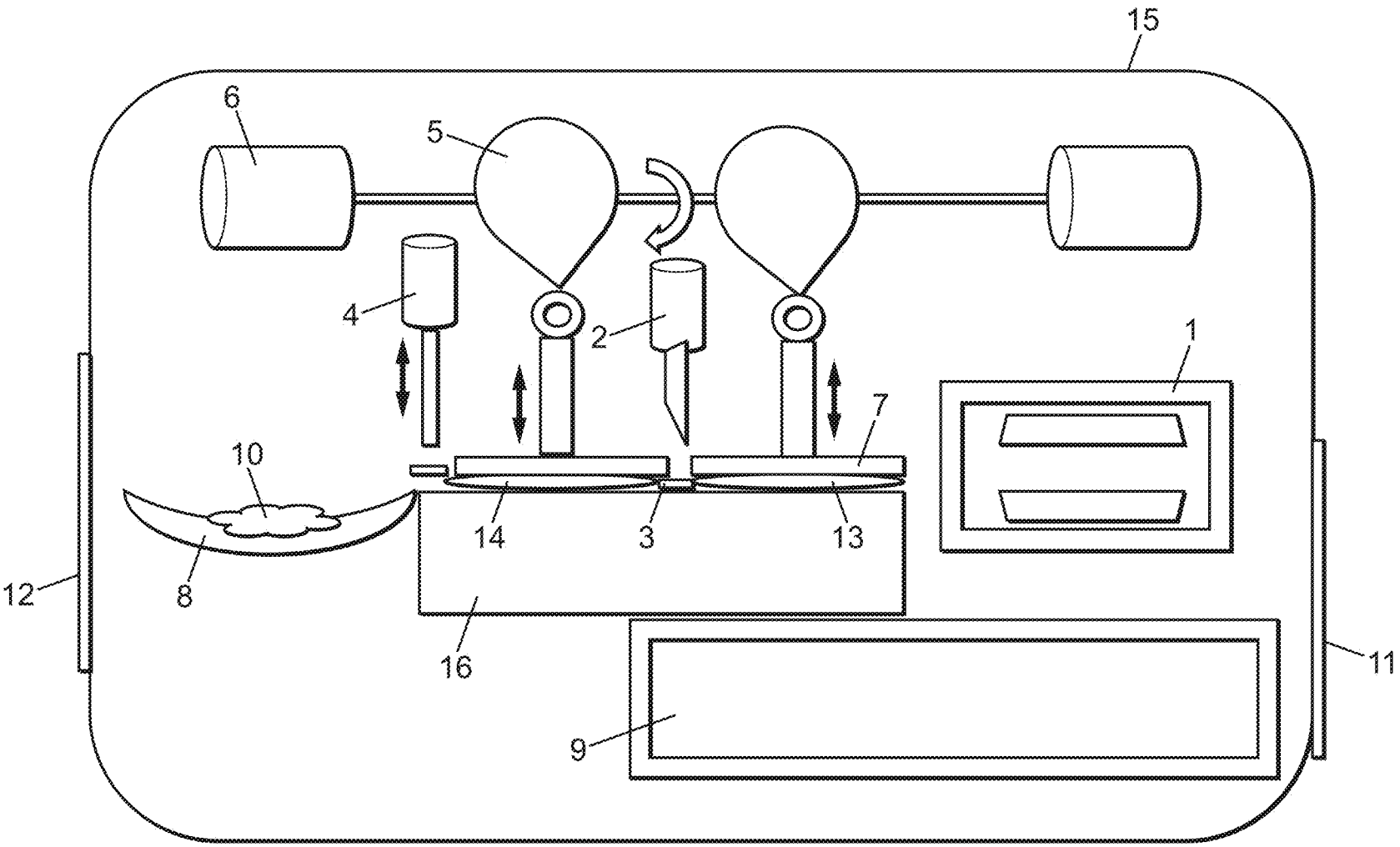
FIG. 4 shows schematically an example of a production system according to an embodiment of the invention shown in a state corresponding to a fourth phase of a production process according to an embodiment of the invention.

FIG. 4 shows schematically an example of a production system according to an embodiment of the invention shown in a state corresponding to a fourth phase of a production process according to an embodiment of the invention.

In an embodiment, the cams 5 do a rotational offset such that the pistons 7 become in phase and are both simultaneously in lower position so as to simultaneously flatten the compartments 13 and 14, whereas the tool for holding 4 goes into upper position and thereby releases the pressure on the emptying area of the compartment 14, thereby leading to the emptying of the homogenized mixture 10 into the receiving cup 8. This homogenized mixture 10 constitutes the personalized cosmetic product 10 ready for immediate or nearly immediate use by the end consumer.

Alternatively, without cup 8, the cams 5 do not do this rotational offset for returning in phase, but instead return into the relative position thereof from FIG. 3. The first piston 7, in lower position, flattens the compartment 13 emptying the content thereof into compartment 14 which is not flattened, since the second piston 7 is then in upper position. The homogenized mixture 10 is then entirely contained in the compartment 14 which will be pushed towards the door 12 and then retrieved by the end consumer after opening this door 12 not on a receiving cup 8 but on a simple tray 8 for receiving the compartment 14. In order to do that, the tool for connecting 2, or another element not shown, can advantageously separate the two compartments 13 and 14 from each other by cutting the sealed link 3 which will then no longer be sealed. The end consumer will extract the personalized cosmetic product 10 from the compartment 14 by simple manual pressure on the compartment 14 leading to the personalized cosmetic product 10 leaving by the open tip which constitutes the part of the link 3 attached the compartment 14.

Alternatively, the machine can operate similarly with two capsules 13 and 14 instead of two compartments of capsules 13 and 14.

Figure 5:
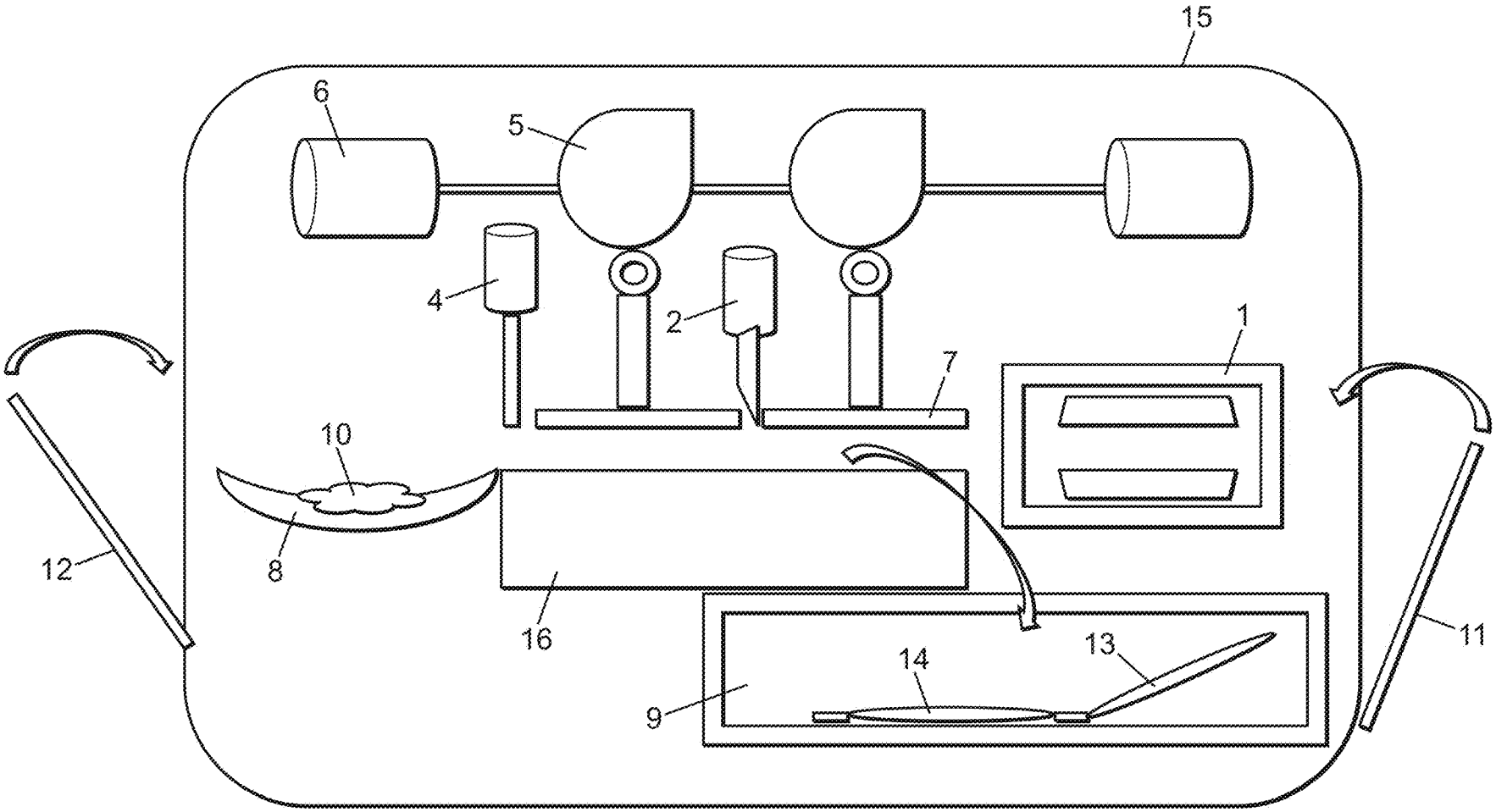
FIG. 5 shows schematically an example of a production system according to an embodiment of the invention shown in a state corresponding to a fifth phase of a production process according to an embodiment of the invention.

FIG. 5 shows schematically an example of a production system according to an embodiment of the invention shown in a state corresponding to a fifth phase of a production process according to an embodiment of the invention.

In an embodiment, the compartments 13 and 14 are cleared into an emptying reservoir 9 which can contain a more or less large number of used capsules with compartments 13 and 14 before needing to be emptied. The clearing of compartments 13 and 14 into an emptying reservoir 9 is indicated on FIG. 5 by a curved arrow going from tray 16 to the emptying reservoir 9. The end consumer can retrieve the one or more used capsules by opening the hatch 11 in order to next throw them out. The end consumer can also open the door 12 in order to retrieve the personalized cosmetic product 10 directly and immediately ready to use in the bottom of the cup 8. The end consumer next only needs to remove the cup 8 from the machine 15, for example by unclipping it, before cleaning this cup 8 and returning it into the machine 15, for example by reclipping it. Whether the personalized cosmetic product 10 is retrieved by the end consumer directly in the receiving cup 8 or in the compartment 14, it is in completely clean single-dose form ready to use by the end consumer. The cup 8 is advantageously stainless steel which could allow a faster cooling of the personalized cosmetic product 10 upon receiving it into the cup 8.

Alternatively, the personalized cosmetic product 10 is gathered with the compartment 14 which contains it and the end consumer can directly and immediately use this personalized cosmetic product 10 by pressing with their fingers on the compartment 14, where the personalized cosmetic product 10 comes out by the tip which constituted the part of the link 3 attached to the compartment 14.

Alternatively, the machine can operate similarly with two capsules 13 and 14 instead of two compartments of capsules 13 and 14.

Of course, the present invention is not limited to the examples and embodiments described and shown, but it is subject to many variants accessible to the person skilled in the art.

The invention claimed is:

1. A system for production of a cosmetic product including:

at least one first single-use packaging unit (13) including a preset quantity of a first phase of the cosmetic product;

at least one second single-use packaging unit (14) that is linkable to at least one first single-use packaging unit, the at least one second single-use packaging unit (14) including a preset quantity of a second phase of the cosmetic product, the at least one first single-use packaging unit being linkable in fluid communication with the at least one second single-use packaging unit, wherein the first phase of the cosmetic product within the at least one first single-use packaging unit (13) is comprised of ingredients different from ingredients that comprise the second phase of the cosmetic product within the at least one second single-use packaging unit (13), wherein, prior to mixing, said first phase of the cosmetic product in the at least one first single-use packaging unit (14) is physically separated from and free of contact with said second phase of the cosmetic product in the at least one second single-use packaging unit (14); and a machine (15) that, with the at least one first single-use packaging unit linked in fluid communication with the at least one second single-use packaging unit, is configured to automatically bring the first phase of the cosmetic product and the second phase of the cosmetic product into contact with each other and mix said preset quantity of said first phase of the cosmetic product and said preset quantity of said second phase of the cosmetic product together to provide the cosmetic product (10) in a form directly consumable by an end consumer, the machine including a housing defining an interior space of the machine, the machine also including a mixer (2, 7, 16) located within the interior space of the machine, the mixer (2, 7, 16) comprising a motorized device that, with the at least one first single-use packaging unit linked in fluid communication with the at least one second single-use packaging unit, is configured to automatically mix said preset quantity of said first phase of the cosmetic product and said preset quantity of said second phase of the cosmetic product to end up with the cosmetic product (10) in the form directly consumable by the end consumer, wherein said mixing is done in an automatic manner and during the mixing neither the first phase of the cosmetic product nor the second phase of the cosmetic product are in direct contact with any part (2, 7, 16) of said mixer which is not single use, thus avoiding dirtying said mixer, wherein the at least one first single-use packaging unit (13) is comprised of a first capsule defining a first capsule compartment with the preset quantity of the first phase of the cosmetic product, and the at least one second single-use packaging unit (14) is comprised of a second capsule defining a second capsule compartment with the preset quantity of the second phase of the cosmetic product, and wherein the first capsule is insertable by the end consumer into the interior of the housing and the second capsule is insertable by the end consumer into the interior of the housing for the mixing to be done in the automatic manner where during the mixing neither the first phase of the cosmetic product from the first capsule compartment nor the second phase of the cosmetic product from the second capsule compartment are in direct contact with any part of said mixer which is not single use.

2. The system for production of a cosmetic product according to claim 1, further comprising a channel element (3) formed between the first capsule compartment of the at least one first single-use packaging unit (13) and the second capsule compartment of the at least one second single-use packaging unit (14), wherein said mixture does not come out of the environment formed by both the at least one first single-use packaging unit (13) and the at least one second single-use packaging unit (14) and also by a junction (3) formed between the at least one first single-use packaging unit (13) and the at least one second single-use packaging unit (14), at all or at least not before the homogenization of said mixture is finished.

3. The system for production of a cosmetic product according to claim 1, wherein, with the at least one first single-use packaging unit linked in fluid communication with the at least one second single-use packaging unit, said mixing includes at least the transfer of content of one of said first and second single-use packaging units (13, 14) to the other of said first and second single-use packaging units (13, 14).

4. The system for production of a cosmetic product according to claim 3, wherein the machine comprises a motorized device providing automatically the transfer of the content from one of the packaging units to one of the other packaging units.

5. The system for production of a cosmetic product according to claim 3, wherein the machine is configured so that said transfer is repeated and reciprocal.

6. The system for production of a cosmetic product according to claim 1, wherein said packaging units are filled at least partially by said preset quantity of their cosmetic product phase before being put into said machine and are sufficiently flexible in order to increase volume so as to be able to contain said mixture in its entirety.

7. The system for production of a cosmetic product according to claim 6, wherein said packaging units were filled under vacuum before they are placed in said machine.

8. The system for production of a cosmetic product according to claim 5, wherein said transfer is accompanied by a stirring of said preset quantity of the first phase and said preset quantity of the second phase in order to homogenize said mixture.

9. The system for production of a cosmetic product according to claim 8, wherein stirring is done by application of mechanical pressure so as to move said mixture from one packaging unit (13, 14) to the other (14, 13), and vice versa.

10. The system for production of a cosmetic product according to claim 9, wherein said mixing is done by the use of pistons (7) or by the use of rollers arranged so as to flatten one of the packaging units (13, 14) in order to move the content thereof into the other packaging unit (14, 13).

11. The system for production of a cosmetic product according to claim 8, wherein said stirring is accompanied by a heating of said preset quantity of the first phase and/or said preset quantity of the second phase in order to improve the homogenization of said mixture.

12. The system for production of a cosmetic product according to claim 3, further comprising a narrowing element located between said first and second single-use packaging units (13, 14), said narrowing element blocking the fluid communication between said first and second single-use packaging units (13, 14), and wherein said transfer is done through the narrowing element located between said single-use packaging units (13, 14), the machine opening the narrowing element allows the fluid communication between said first and second single-use packaging units (13, 14).

13. The system for production of a cosmetic product according to claim 3, further comprising a narrowing element located in a link between said first and second single-use packaging units (13, 14), in an initial closed state said narrowing element blocking the link and thereby blocking the fluid communication between said first and second single-use packaging units (13, 14), wherein the narrowing element is openable by the machine to open the link and thereby place the at least one first single-use packaging unit in fluid communication with the at least one second single-use packaging unit to thereby allow the fluid communication between said first and second single-use packaging units (13, 14), wherein said mixing includes at least the transfer of content of one of said first and second single-use packaging units (13, 14) to the other of said first and second single-use packaging units (13, 14), and wherein said transfer is done through the narrowing element located between said single-use packaging units (13, 14) after the machine opening the narrowing element to allow the fluid communication between said first and second single-use packaging units (13, 14).

14. The system for production of a cosmetic product according to claim 12, wherein said narrowing element (3) has a size or a diameter which amounts to at most 20% of the size or diameter of the one or more packaging units (13, 14) which bear said narrowing element.

15. The system for production of a cosmetic product according to claim 14, wherein said narrowing element (3) has a size or a diameter which amounts to at least 2% of the size or diameter of the one or more packaging units (13, 14) which bear said narrowing element.

16. The system for production of a cosmetic product according to claim 5, wherein said cosmetic product (10), directly consumable by the end consumer, is stored in one of said single-use packaging units (13, 14) and/or in the other of said single-use packaging units (13, 14).

17. The system for production of a cosmetic product according to claim 5, wherein said cosmetic product (10) directly consumable by the end consumer is stored directly in a receptacle (8) that is removable and external to the mixer (2, 7, 16) of the machine (15).

18. The system for production of a cosmetic product according to claim 1, wherein said cosmetic product (10) directly consumable by the end consumer is a homogenized emulsion or homogenized solution or mixture of several miscible phases.

19. The system for production of a cosmetic product according to claim 1 wherein said first single-use packaging unit (13) includes a preset quantity of an excipient phase of a cosmetic product, said second single-use packaging unit (14) includes a preset quantity of a phase including active elements for a cosmetic product where said second packaging unit (14) is sterilized.

20. The system for production of a cosmetic product according to claim 1, wherein said first single-use packaging unit (13) includes a preset quantity of a fatty phase of a cosmetic product, said second single-use packaging unit (14) includes a preset quantity of an aqueous phase of a cosmetic product where said second packaging unit (14) is sterilized.

21. A system for production of a cosmetic product including:

at least one first single-use packaging unit (13) including a preset quantity of a fatty phase of a cosmetic product, at least one second single-use packaging unit (14) including a preset quantity of an aqueous phase of a cosmetic product, the at least one first single-use packaging unit being linkable in fluid communication with the at least one second single-use packaging unit, wherein the first phase of the cosmetic product within the at least one first single-use packaging unit (13) is different from the second phase of the cosmetic product within the at least one second single-use packaging unit (13), wherein said first phase of the cosmetic product in the at least one first single-use packaging unit (14) is physically separated from and free of contact with said second phase of the cosmetic product in the at least one second single-use packaging unit (14) prior to mixing, and a machine (15) inside of which brings the first phase of the cosmetic product into contact with the second phase of the cosmetic product and the mixing of said preset quantity of said aqueous phase and said preset quantity of said fatty phase is done automatically in order to end up with a cosmetic product (10) directly consumable by an end consumer, wherein the at least one first single-use packaging unit (13) is comprised of a first capsule defining a first capsule compartment with the preset quantity of a first phase of the cosmetic product, and the at least one second single-use packaging unit (14) is comprised of a second capsule defining a second capsule compartment with the preset quantity of a second phase of the cosmetic product, and wherein the first capsule is insertable by the end consumer into the interior of the housing and the second capsule is insertable by the end consumer into the interior of the housing for the mixing to be done in the automatic manner where during the mixing neither the first phase of the cosmetic product from the first capsule compartment nor the second phase of the cosmetic product from the second capsule compartment are in direct contact with any part of said mixer which is not single use.

22. The system for production of a cosmetic product according to claim 21, wherein said fatty phase of said cosmetic product can be of different types corresponding to different forms, and said aqueous phase of said cosmetic product can include different groups of active elements corresponding to different skin needs of the end consumer.

23. A system for production of a cosmetic product including:

at least one first single-use packaging unit (13) including a preset quantity of a first phase of the cosmetic product;

at least one second single-use packaging unit (14) including a preset quantity of a second phase of the cosmetic product;

a link (3) located between the at least one first single-use packaging unit (13) and the at least one second single-use packaging unit (14), wherein the first phase of the cosmetic product within the at least one first single-use packaging unit (13) is different from the second phase of the cosmetic product within the at least one second single-use packaging unit (13), wherein said link (3) physically separates said first phase of the cosmetic product in the at least one first single-use packaging unit from said second phase of the cosmetic product in the at least one second single-use packaging unit so that said first phase of the cosmetic product is physically separated by said link (3) and free of contact with said second phase of the cosmetic product prior to mixing; and a machine (15) including a housing defining an interior space of the machine, the machine also including a mixer (2, 7, 16) located within the interior space of the machine, the mixer (2, 7, 16) configured to automatically mix said preset quantity of said first phase of the cosmetic product with said preset quantity of said second phase of the cosmetic product in order to end up with the cosmetic product (10) in an homogenized form directly consumable by an end consumer, the mixer (2, 7, 16) including a motorized device that is configured to automatically transfer, via the link, the first phase of the cosmetic product to the at least one second single-use packaging unit (14) or to automatically transfer, via the link, the second phase of the cosmetic product to the at least one first single-use packaging unit (14) to bring the first phase of the cosmetic product into contact with the second phase of the cosmetic product and end up with the cosmetic product (10) in the homogenized form directly consumable by the end consumer, wherein the at least one first single-use packaging unit (13) is comprised of a first capsule defining a first capsule compartment with the preset quantity of the first phase of the cosmetic product, and the at least one second single-use packaging unit (14) is comprised of a second capsule defining a second capsule compartment with the preset quantity of the second phase of the cosmetic product, wherein the first capsule is insertable by the end consumer into the interior of the housing and the second capsule is insertable by the end consumer into the interior of the housing for the mixing to be done in the automatic manner where during the mixing neither the first phase of the cosmetic product from the first capsule compartment nor the second phase of the cosmetic product from the second capsule compartment are in direct contact with any part of said mixer which is not single use, wherein said mixing is done in a manner such that neither the first phase of the cosmetic product nor the second phase of the cosmetic product are in direct contact with any part (2, 7, 16) of said mixer which is not single use, thus avoiding dirtying said mixer, and wherein prior to the cosmetic product (10) being in the homogenized form directly consumable by the end consumer, said mixture does not come out of the environment formed by the interior of said at least one first single-use packaging unit (13), and the interior of said at least one second single-use packaging unit (14), and the interior of said link (3) formed between said packaging units (13, 14).

24. A system for production of a cosmetic product including:

at least one first single-use packaging unit (13) including a preset quantity of a first phase of the cosmetic product;

at least one second single-use packaging unit (14) including a preset quantity of a second phase of the cosmetic product;

a link (3) located between and connecting the at least one first single-use packaging unit (13) and the at least one second single-use packaging unit (14), wherein the first phase of the cosmetic product within the at least one first single-use packaging unit (13) is different from the second phase of the cosmetic product within the at least one second single-use packaging unit (13), wherein said link (3) physically separates said first phase of the cosmetic product in the at least one first single-use packaging unit from said second phase of the cosmetic product in the at least one second single-use packaging unit so that said first phase of the cosmetic product is physically separated by said link (3) and free of contact with said second phase of the cosmetic product prior to mixing; and a machine (15) including a housing defining an interior space of the machine, the machine also including a mixer (2, 7, 16) located within the interior space of the machine, the mixer (2, 7, 16) configured to automatically bring the first phase of the cosmetic product into contact with the second phase of the cosmetic product and mix said preset quantity of said first phase of the cosmetic product with said preset quantity of said second phase of the cosmetic product in order to end up with the cosmetic product (10) in an homogenized form directly consumable by an end consumer, the mixer (2, 7, 16) including a motorized device that is configured to automatically transfer, via the link, the first phase of the cosmetic product to the at least one second single-use packaging unit (14) or to automatically transfer, via the link, the second phase of the cosmetic product to the at least one first single-use packaging unit (14) to bring the first phase of the cosmetic product into contact with the second phase of the cosmetic product and end up with the cosmetic product (10) in the homogenized form directly consumable by the end consumer, wherein the at least one first single-use packaging unit (13) is comprised of a first capsule defining a first capsule compartment with the preset quantity of the first phase of the cosmetic product, and the at least one second single-use packaging unit (14) is comprised of a second capsule defining a second capsule compartment with the preset quantity of the second phase of the cosmetic product, wherein the first capsule is insertable by the end consumer into the interior of the housing and the second capsule is insertable by the end consumer into the interior of the housing for the mixing to be done in the automatic manner where during the mixing neither the first phase of the cosmetic product from the first capsule compartment nor the second phase of the cosmetic product from the second capsule compartment are in direct contact with any part of said mixer which is not single use, wherein said mixing is done in a manner such that neither the first phase of the cosmetic product nor the second phase of the cosmetic product are in direct contact with any part (2, 7, 16) of said mixer which is not single use, thus avoiding dirtying said mixer, and wherein prior to the cosmetic product (10) being in the homogenized form directly consumable by the end consumer, said mixture does not come out of the environment formed by the interior of said at least one first single-use packaging unit (13), the interior of said at least one second single-use packaging unit (14), and the interior of the link (3) formed between said packaging units (13, 14), and wherein the mixer (2, 7, 16) is configured to repeated and reciprocally perform said transfer via the link.

25. A system for production of a cosmetic product including:

at least one first single-use packaging unit (13) including a preset quantity of a first phase of the cosmetic product;

at least one second single-use packaging unit (14) including a preset quantity of a second phase of the cosmetic product;

a link (3) located between and connecting the at least one first single-use packaging unit (13) and the at least one second single-use packaging unit (14), the link including a narrowing, wherein the first phase of the cosmetic product within the at least one first single-use packaging unit (13) is different from the second phase of the cosmetic product within the at least one second single-use packaging unit (13), wherein said narrowing physically separates said first phase of the cosmetic product in the at least one first single-use packaging unit from said second phase of the cosmetic product in the at least one second single-use packaging unit so that said first phase of the cosmetic product is physically separated by said narrowing and free of contact with said second phase of the cosmetic product prior to mixing; and a machine (15) including a housing defining an interior space of the machine, the machine also including a mixer (2, 7, 16) located within the interior space of the machine, the mixer (2, 7, 16) configured to automatically mix said preset quantity of said first phase of the cosmetic product with said preset quantity of said second phase of the cosmetic product in order to end up with the cosmetic product (10) in an homogenized form directly consumable by an end consumer, the mixer (2, 7, 16) including a motorized device that is configured to automatically transfer, via the link and the narrowing, the first phase of the cosmetic product to the at least one second single-use packaging unit (14) or to automatically transfer, via the link and the narrowing, the second phase of the cosmetic product to the at least one first single-use packaging unit (14) to bring the first phase of the cosmetic product into contact with the second phase of the cosmetic product and end up with the cosmetic product (10) in the homogenized form directly consumable by the end consumer, wherein the at least one first single-use packaging unit (13) is comprised of a first capsule defining a first capsule compartment with the preset quantity of the first phase of the cosmetic product, and the at least one second single-use packaging unit (14) is comprised of a second capsule defining a second capsule compartment with the preset quantity of the second phase of the cosmetic product, wherein the first capsule is insertable by the end consumer into the interior of the housing and the second capsule is insertable by the end consumer into the interior of the housing for the mixing to be done in the automatic manner where during the mixing neither the first phase of the cosmetic product from the first capsule compartment nor the second phase of the cosmetic product from the second capsule compartment are in direct contact with any part of said mixer which is not single use, wherein said mixing is done in a manner such that neither the first phase of the cosmetic product nor the second phase of the cosmetic product are in direct contact with any part (2, 7, 16) of said mixer which is not single use, thus avoiding dirtying said mixer, and wherein prior to the cosmetic product (10) being in the homogenized form directly consumable by the end consumer, said mixture does not come out of the environment formed by the interior of said at least one first single-use packaging unit (13), the interior of said at least one second single-use packaging unit (14), and the interior of said link (3) formed between said packaging units (13, 14).

26. A system for production of a cosmetic product according to claim 25, wherein the mixer (2, 7, 16) is configured to repeated and reciprocally perform said transfer via the link.

27. A system for production of a cosmetic product according to claim 1, wherein said first capsule and said second capsule are respectively two capsules independent from each other.

* * * * *